US008328603B2

(12) United States Patent
Jung et al.

(10) Patent No.: US 8,328,603 B2
(45) Date of Patent: Dec. 11, 2012

(54) APPARATUS FOR STRESS SHOT PEENING OF COIL SPRING

(75) Inventors: Chan-Gi Jung, Incheon (KR); Ui-Seok Yoon, Changwon (KR)

(73) Assignee: Dae Won Kang Up Co., Ltd. (KR)

( * ) Notice: Subject to any disclaimer, the term of this patent is extended or adjusted under 35 U.S.C. 154(b) by 187 days.

(21) Appl. No.: 12/863,067

(22) PCT Filed: Jul. 10, 2008

(86) PCT No.: PCT/KR2008/004073
§ 371 (c)(1),
(2), (4) Date: Jul. 15, 2010

(87) PCT Pub. No.: WO2009/133989
PCT Pub. Date: Nov. 5, 2009

(65) Prior Publication Data

US 2011/0053471 A1 Mar. 3, 2011

(30) Foreign Application Priority Data

Apr. 30, 2008 (KR) ..... 10-2008-0040592

(51) Int. Cl.
*B24C 3/04* (2006.01)
*B24C 3/14* (2006.01)
*B24C 9/00* (2006.01)
*B24C 1/10* (2006.01)

(52) U.S. Cl. ..... 451/81; 72/53; 451/80

(58) Field of Classification Search ..... 451/11, 451/16, 39, 28, 41, 80–83, 94–96, 364, 411; 72/53; 198/728; *B24C 3/04, 3/14, 9/00, B24C 1/10*
See application file for complete search history.

(56) References Cited

U.S. PATENT DOCUMENTS 2,131,776 A * 10/1938 Wean et al. ..... 451/80
2,154,879 A * 4/1939 Turnbull ..... 451/83
(Continued)

FOREIGN PATENT DOCUMENTS

JP 05-031671 2/1993
(Continued)

OTHER PUBLICATIONS

International Search Report—PCT/KR2008/004073 dated Jan. 9, 2009.
(Continued)

*Primary Examiner* — Lee D Wilson
*Assistant Examiner* — Marc Carlson
(74) *Attorney, Agent, or Firm* — Cantor Colburn LLP

(57) ABSTRACT

An apparatus for stress shot peening of a coil spring is disclosed. The apparatus of the present invention is constructed such that coil springs, which are compressed and clamped by corresponding spring clamping units (20) facing each other, are rotated on their own axes and are simultaneously supplied into the shot room (10) for shot peening. Therefore, the present invention can markedly enhance the internal stress of the coil spring, compared to a coil spring treated by the conventional shot peening apparatus. Furthermore, in the present invention, because the coil springs are clamped by the corresponding spring clamping units facing each other and are simultaneously rotated and moved into the shot room for shot peening, various kinds of side load coil springs, as well as a typical cylindrical coil spring, can be evenly treated throughout the entire surface thereof by shot peening.

7 Claims, 7 Drawing Sheets

U.S. PATENT DOCUMENTS

| | | | | | |
|---|---|---|---|---|---|
| 2,604,734 | A | * | 7/1952 | Huyett et al. | 451/83 |
| 2,887,826 | A | * | 5/1959 | Schultz | 451/80 |
| 3,131,457 | A | * | 5/1964 | Correll et al. | 72/53 |
| 3,383,803 | A | * | 5/1968 | Schulte et al. | 451/83 |
| 4,019,624 | A | * | 4/1977 | Torres | 198/459.8 |
| 4,326,362 | A | * | 4/1982 | Williams et al. | 451/80 |
| 4,337,632 | A | * | 7/1982 | Lienert | 72/53 |
| 4,423,613 | A | * | 1/1984 | DeClark et al. | 72/53 |
| 4,492,102 | A | * | 1/1985 | Lienert | 72/53 |
| 4,599,879 | A | * | 7/1986 | Lienert | 72/53 |
| 4,604,881 | A | * | 8/1986 | Lienert | 72/53 |
| 4,793,103 | A | * | 12/1988 | Baumgart | 451/81 |
| 5,409,415 | A | * | 4/1995 | Kawanami et al. | 451/39 |
| 5,591,066 | A | * | 1/1997 | Vondracek | 451/80 |
| 6,319,101 | B1 | * | 11/2001 | Vago | 451/94 |
| 7,946,009 | B2 | * | 5/2011 | Dixon et al. | 29/90.7 |
| 2008/0066512 | A1 | * | 3/2008 | Ushida et al. | 72/53 |

FOREIGN PATENT DOCUMENTS

| | | |
|---|---|---|
| JP | 2002-361558 | 12/2002 |
| JP | 2003-117830 | 4/2003 |
| KR | 10-0176279 | 12/1995 |
| KR | 10-2000-0070216 | 11/2000 |
| WO | 98/31505 | 7/1998 |

OTHER PUBLICATIONS

Written Opinion—PCT/KR2008/004073 dated Jan. 9, 2009.

* cited by examiner

APPARATUS FOR STRESS SHOT PEENING OF COIL SPRING

TECHNICAL FIELD

The present invention relates, in general, to apparatuses for stress shot peening of coil springs and, more particularly, to an apparatus for stress shot peening of a coil spring which is constructed such that the coil spring is clamped by the apparatus in a state of being compressed and is rotated on its own axis while passing through a shot room for shot peening, so that the internal stress of the coil spring can be increased, and, as well as a typical cylindrical coil spring, various kinds of side load coil springs can be evenly treated throughout the entire surface thereof by shot peening.

BACKGROUND ART

Below, conventional techniques and problems thereof will be explained.

Generally, coil springs repeatedly undergo compressive stress. With regard to this, the surface of the coil springs are typically treated by shot peening to increase the internal stress thereof.

In conventional shot peening apparatuses which treat the surfaces of coil springs through shot peening processes to increase the internal stress thereof, coil springs are placed on a pair of rollers which are rotated. The coil springs are rotated by the rotation of the rollers. Simultaneously, a roller moving device, which is coupled to the rollers, is operated to pass the rollers and the coil springs through a shot room. Thereby, the surfaces of the coil springs are treated by shot peening.

Here, when treating coil springs through the shot peening process, if the coil springs are in the compressed state, the internal stress of the coil springs can be further increased. However, in the case of the conventional shot peening apparatuses, coil springs are only rotated in the original states thereof without being compressed, when they are treated by shot peening. Therefore, there is a problem in that high quality products, that is, coil springs having increased internal stress, cannot be produced.

Furthermore, the conventional shot peening apparatuses allow coil springs to be freely rotated on the rollers without holding the opposite ends of the coil springs. Thus, a typical coil spring having a basic cylindrical shape is evenly treated by shot peening throughout the entire surface thereof. However, in the case of a side load coil spring, which is increased in diameter from the opposite ends thereof to the medial portion thereof, when the side load coil spring is rotated, the longitudinal axis thereof cannot maintain a horizontal state, in other words, the coil spring suffers irregular seesaw motion, in which the opposite ends thereof are moved upwards and downwards. Therefore, the coil spring cannot be evenly treated by shot peening through the entire surface thereof.

DISCLOSURE OF INVENTION

Technical Problem

Accordingly, the present invention has been made keeping in mind the above problems occurring in the prior art, and an object of the present invention is to provide an apparatus for stress shot peening of a coil spring which can markedly enhance the internal stress of the coil spring, compared to a coil spring treated by the conventional shot peening apparatus.

Another object of the present invention is to provide an apparatus for stress shot peening of a coil spring which is constructed such that, as well as a typical cylindrical coil spring, various kinds of side load coil springs can be evenly treated throughout the entire surface thereof by shot peening.

Technical Solution

In order to accomplish the above objects, the present invention provides an apparatus for stress shot peening of a coil spring, including: a pair of bucket conveyors provided on a rear portion of a base, the bucket conveyors being mounted at lower ends thereof to an upper surface of the base; a shot room coupled at a lower end thereof to the lower ends of the bucket conveyors, with a pair of screws provided in a central portion of a lower end of the shot room, the screws being coupled to each other by a connection member, wherein one selected from between the screws is coupled to a first drive motor provided on the upper surface of the base; a separator coupled at opposite ends thereof to the respective bucket conveyors, with a separator screw provided in the separator, the separator screw being connected at one end thereof to a second drive motor; a plurality of impellers provided on an upper surface of the shot room and coupled to the separator to discharge shot balls into the shot room; conveyor lifting units respectively provided on first and second ends of the upper surface of the base; a spring input conveyor coupled to the conveyor lifting unit provided on the first end of the upper surface of the base, the spring input conveyor being adjusted in height by the corresponding conveyor lifting unit; a spring output conveyor coupled to the conveyor lifting unit provided on the second end of the upper surface of the base, the spring output conveyor being adjusted in height by the corresponding conveyor lifting unit; width adjustment units respectively provided on medial portions of front and rear ends of the upper surface of the base such that inner ends of upper portions of the width adjustment units are disposed in the shot room; a clamping unit revolving chain provided on each of the width adjustment units such that a portion of the clamping unit revolving chain is disposed in the shot room, the clamping unit revolving chain being wrapped at two positions around drive sprockets, which are rotatably provided on respective opposite ends of an upper surface of the corresponding width adjustment unit, so that the clamping unit revolving chain is revolved around the drive sprockets by the drive sprockets; a sprocket drive unit provided on a second end of the upper surface of the shot room, the sprocket drive unit being coupled to the drive sprockets provided on the corresponding ends of the upper surfaces of the respective width adjustment units; a plurality of spring clamping units mounted to each clamping unit revolving chain at position spaced apart from each other at regular intervals, the spring clamping units being oriented outwards with respect to the clamping unit revolving chain; and a clamping unit rotating chain provided on each of the width adjustment units, the clamping unit rotating chain being disposed outside the corresponding clamping unit revolving chain, the clamping unit rotating chain engaging with medial portions of the corresponding spring clamping units, thus rotating the spring clamping units on axes thereof, the spring clamping units being revolved around the corresponding sprockets by the corresponding clamping unit revolving chain.

Preferably, each conveyor lifting unit may include: a third drive motor provided on the upper surface of the base; a vertical moving screw coupled at a lower end thereof to the third drive motor, the vertical moving screw being rotated by operation of the third drive motor; and a vertical moving block threaded over the vertical moving screw, the vertical moving block being fastened to a central portion of the spring input conveyor or the spring output conveyor.

Furthermore, each width adjustment unit may include: a fourth drive motor provided on a medial portion of the front or rear end of the upper surface of the base; a width adjustment screw rotatably supported at opposite ends thereof by support brackets provided on the upper surface of the base, the width adjustment screw being coupled at one end thereof to the fourth drive motor; a width adjustment block threaded over the width adjustment screw; and a width adjustment support provided on an upper surface of the width adjustment block such that the inner end thereof is disposed in the shot room, the width adjustment support supporting thereon the corresponding drive sprockets, which revolve the corresponding clamping unit revolving chain.

In addition, the sprocket drive unit may include: a pair of rotating force transmitting shafts coupled at lower ends thereof to the drive sprockets that are provided on second ends of upper surfaces of the respective width adjustment units and are connected to the respective clamping unit revolving chains; a gear box provided on a second end of an upper surface of the shot room, the gear box being coupled to upper ends of the rotating force transmitting shafts; and a fifth drive motor coupled to the gear box.

Here, the gear box may include: a drive gear connected to the fifth drive motor, the drive gear being rotated by operation of the drive motor; a first driven gear engaging with the drive gear at a first position, the first driven gear being connected to an upper end of one of the rotating force transmitting shafts to rotate the corresponding rotating force transmitting shaft in a direction opposite a direction, in which the drive gear rotates; a second driven gear engaging with the drive gear at a second position to rotate in a direction opposite the direction, in which the drive gear rotates; and a third driven gear engaging with the second driven gear, the third driven gear being connected to an upper end of a remaining one of the rotating force transmitting shafts to rotate the corresponding rotating force transmitting shaft in the direction, in which the drive gear rotates.

Meanwhile, each spring clamping unit may include: a coupling member coupled at a first end thereof to the corresponding clamping unit revolving chain such that the coupling member is oriented outwards with respect to the clamping unit revolving chain; a rotation member rotatably coupled at a first end thereof to a circumferential outer surface of a second end of the coupling member; a sprocket provided on a central portion of a circumferential outer surface of the rotation member, the sprocket engaging with the corresponding clamping unit rotating chain, so that the sprocket is rotated by the clamping unit rotating chain when the coupling member is moved by the clamping unit revolving chain, thus rotating the rotation member; a support member coupled at a first end thereof to a second end of the rotation member using a plurality of locking members such that the support member is rotated in conjunction with the rotation member; and holding members mounted at first ends thereof to a second end of the support member, the holding members being disposed into a circular arrangement, so that second ends of the holding members are inserted into one end of a coil spring to hold the coil spring.

Here, each holding member may have a right-angled triangular shape, a width of which is increased from a second end thereof, which is inserted into the end of the coil spring, to the first end thereof.

As described above, the stress shot peening apparatus according to the present invention is constructed such that coil springs, which are compressed and clamped by the corresponding spring clamping units facing each other, are rotated on their own axes and are simultaneously supplied into the shot room for shot peening. Therefore, the present invention can markedly enhance the internal stress of the coil spring, compared to a coil spring treated by the conventional shot peening apparatus.

Furthermore, in the stress shot peening apparatus according to the present invention, because the coil springs are clamped by the corresponding spring clamping units facing each other and are simultaneously rotated and moved into the shot room for shot peening, various kinds of side load coil springs, as well as a typical cylindrical coil spring, can be evenly treated throughout the entire surface thereof by shot peening.

Figure 1:
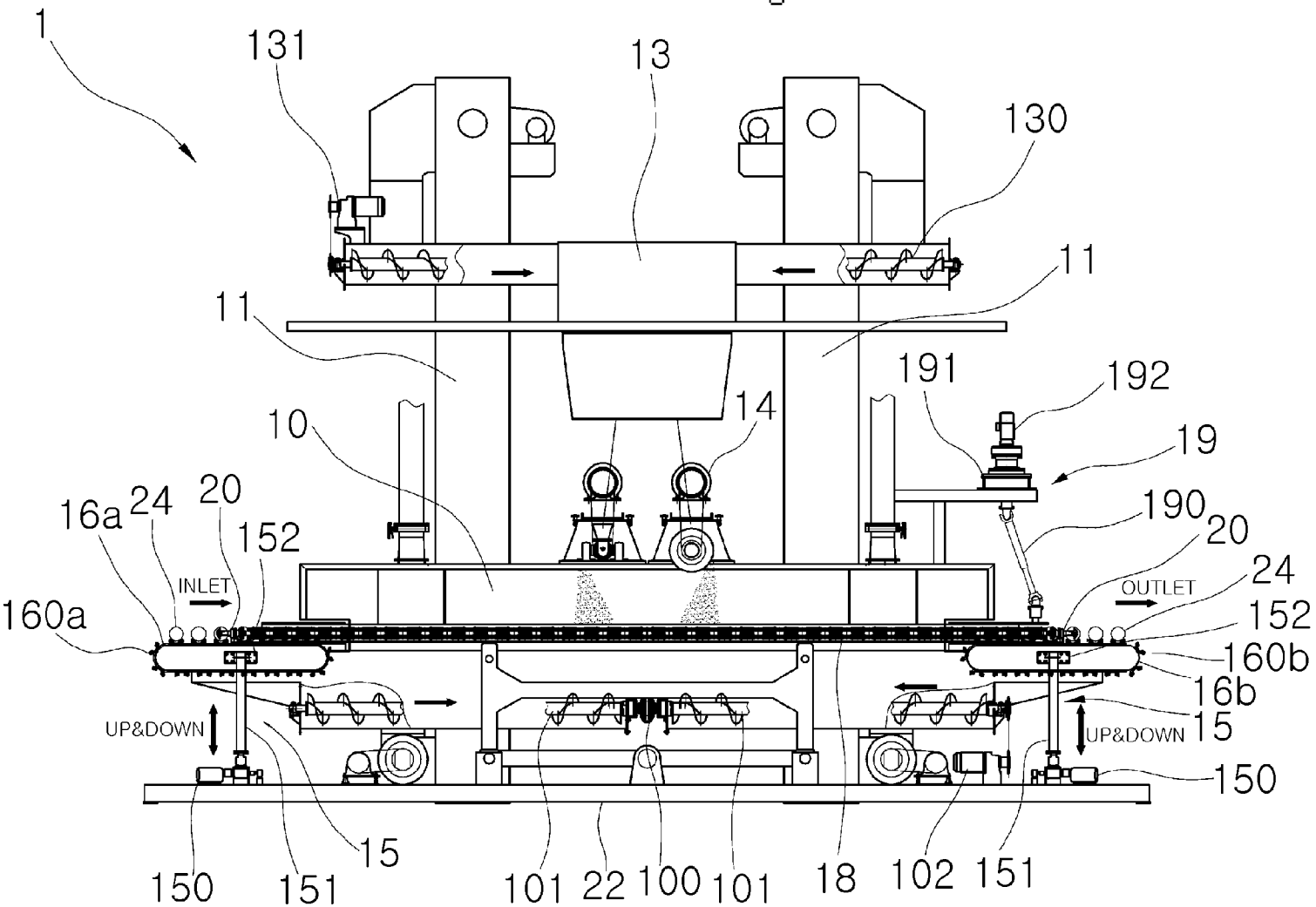
FIG. 1 is a front view illustrating an apparatus for stress shot peening of a coil spring, according to an embodiment of the present invention.

DESCRIPTION OF THE ELEMENTS IN THE DRAWINGS (1): stress shot peening apparatus (10): shot room
(11): bucket conveyor (13) separator
(14): impeller (15): conveyor lifting units
(16*a*): spring input conveyor (16*b*): spring output conveyor
(17): width adjustment unit (18): clamping unit revolving chain
(19): sprocket drive unit (20): spring clamping unit
(21): clamping unit rotating chain

BEST MODE FOR CARRYING OUT THE INVENTION

Hereinafter, the present invention will be described in detail with reference to the attached drawings.

Figure 2:
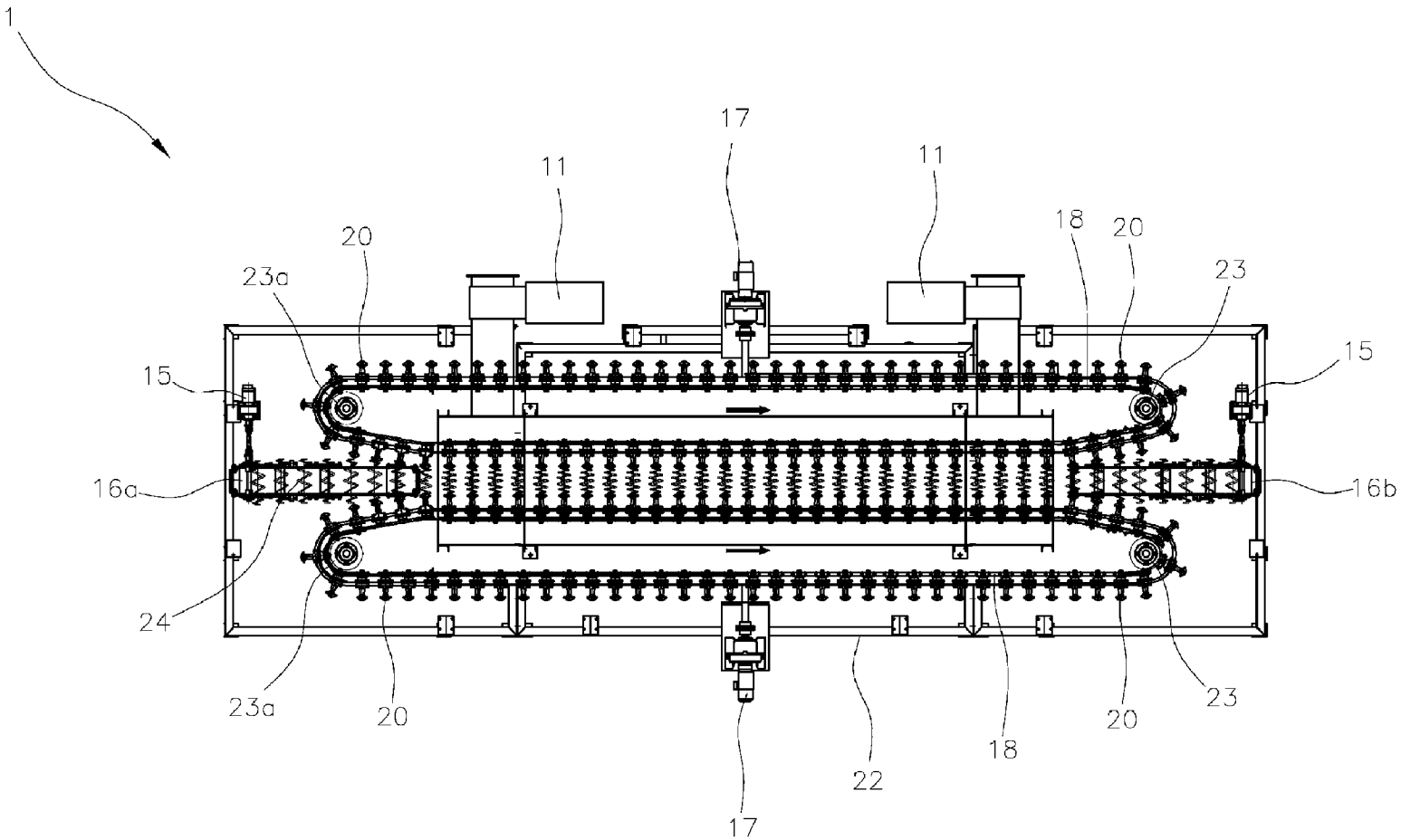
FIG. 2 is a plan view illustrating the apparatus for stress shot peening of the coil spring according to the embodiment of the present invention.
Figure 3:
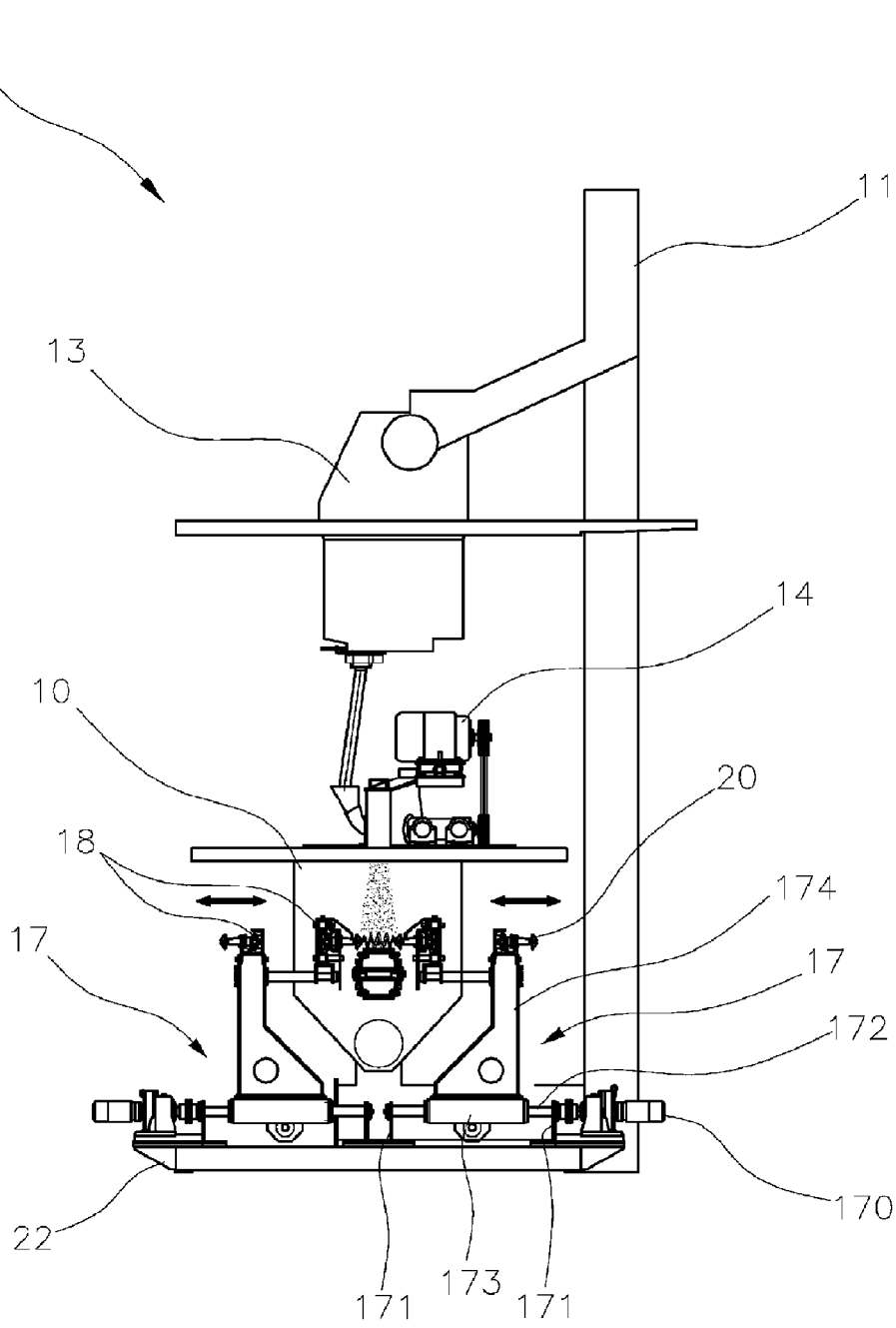
FIG. 3 is a side view illustrating the apparatus for stress shot peening of the coil spring according to the embodiment of the present invention.
Figure 4:
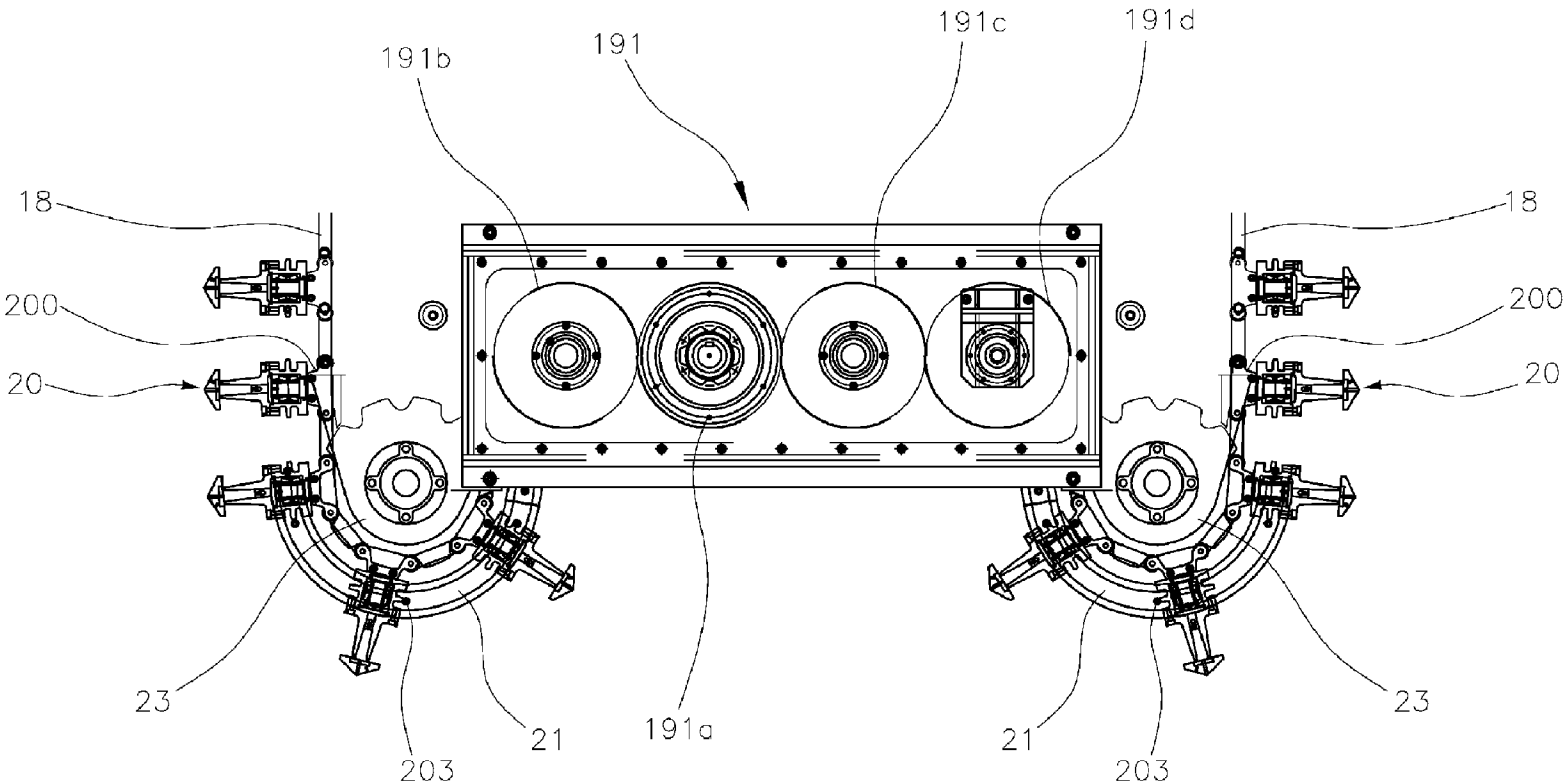
FIG. 4 is a view showing the construction of a sprocket drive unit according to the present invention.
Figure 5:
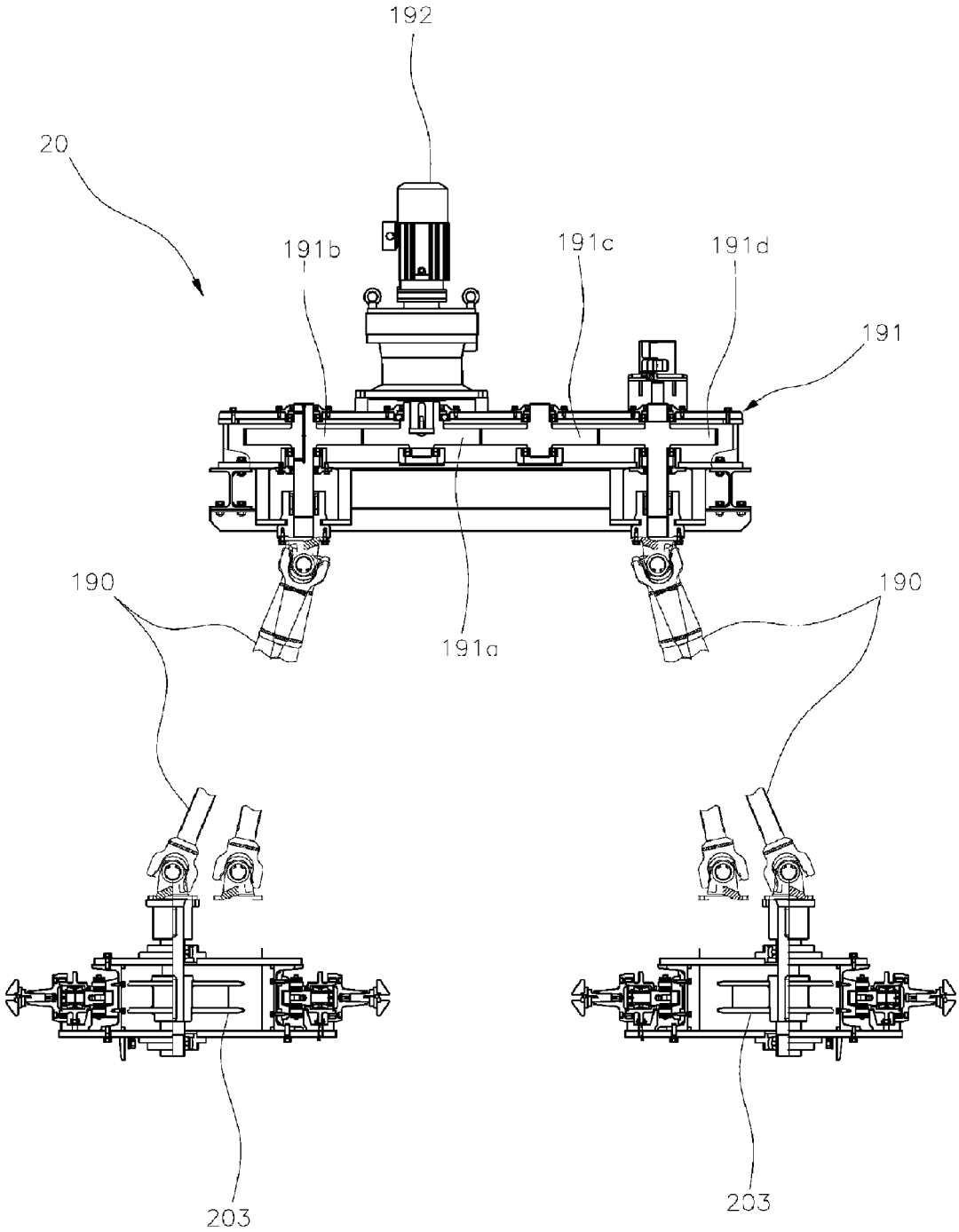
FIG. 5 is a front view of FIG. 4.
Figure 6:
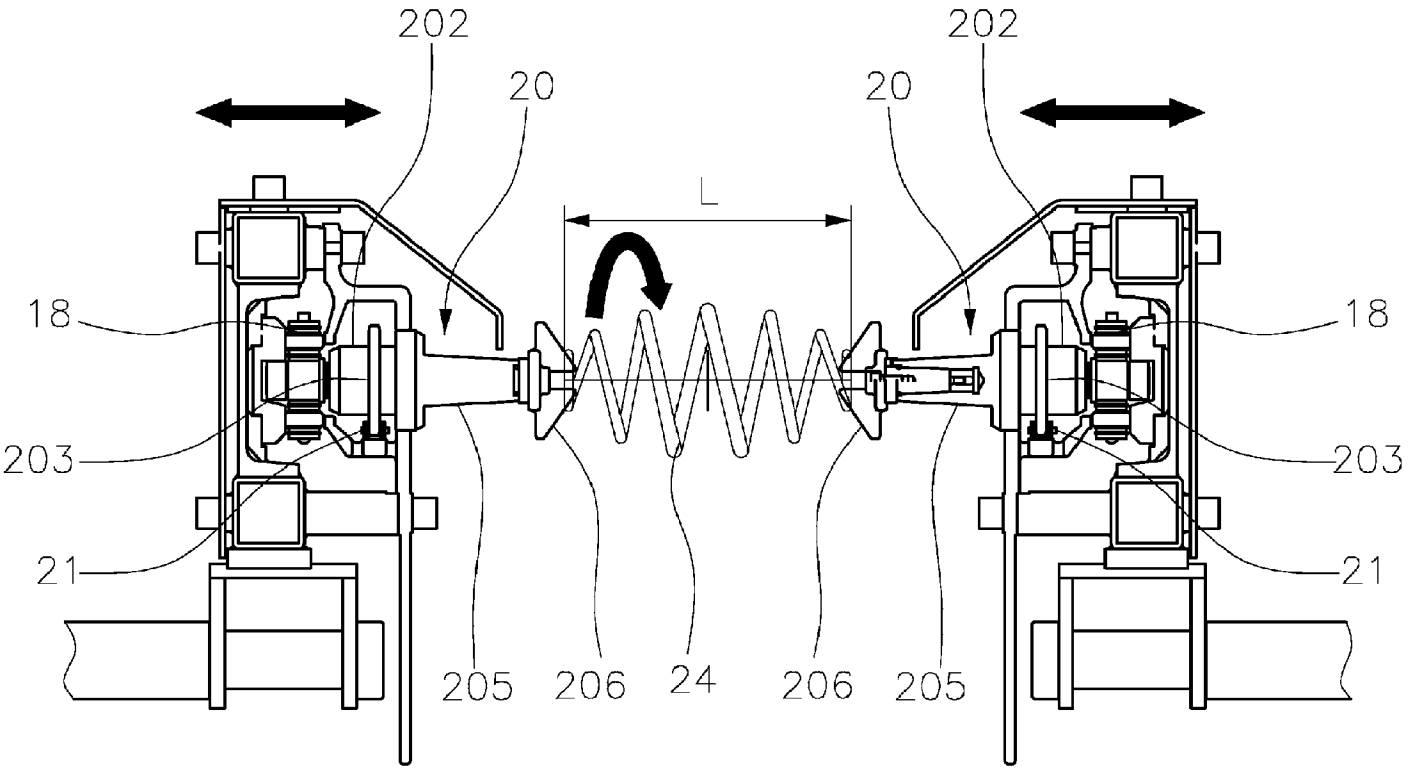
FIG. 6 is a view showing the spring held by a spring clamping unit according to the present invention.
Figure 7:
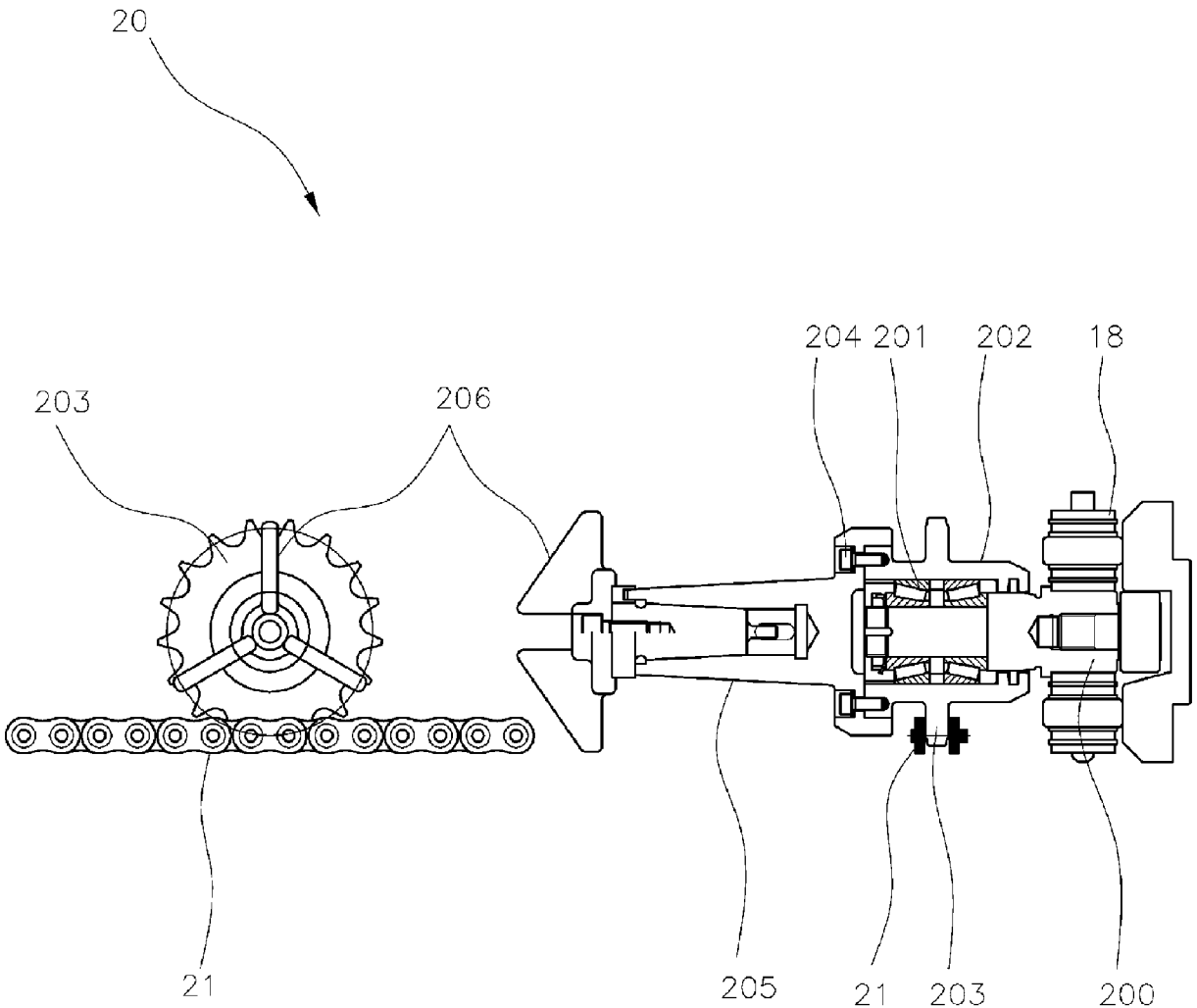
FIG. 7 is a detailed view of the spring clamping unit.

FIG. 1 is a front view illustrating an apparatus for stress shot peening of a coil spring, according to an embodiment of the present invention. FIG. 2 is a plan view illustrating the apparatus for stress shot peening of the coil spring according to the embodiment of the present invention. FIG. 3 is a side view illustrating the apparatus for stress shot peening of the coil spring according to the embodiment of the present invention. FIG. 4 is a view showing the construction of a sprocket drive unit. FIG. 5 is a front view of FIG. 4. FIG. 6 is a view showing the spring held by a spring clamping unit. FIG. 7 is a detailed view of the spring clamping unit.

Referring to FIGS. 1 through 7, the stress shot peening apparatus 1 according to the embodiment of the present invention includes a shot room 10, a pair of bucket conveyors 11, a separator 13, a plurality of impellers 14, a pair of conveyor lifting units 15, a spring input conveyor 16*a*, a spring output conveyor 16*b*, a pair of width adjustment units 17, a pair of clamping unit revolving chains 18, a sprocket drive unit 19, a plurality of spring clamping units 20, and a pair of clamping unit rotating chains 21.

In the stress shot peening apparatus 1 according to the embodiment of the present invention, the bucket conveyors 11 is disposed on a rear portion of a base 22 and is mounted at the lower ends thereof to the upper surface of the base 22.

The shot room 10 is coupled at the lower end thereof to the lower ends of the bucket conveyors 11. A pair of screws 101, which are coupled to each other by a connection member 100, is installed in the central portion of the lower end of the shot room 10. One selected from between the screws 101 is coupled to a drive motor 102, which is installed on the upper surface of the base 22.

The opposite ends of the separator 13 are coupled to the respective bucket conveyors 11. A separator screw 130 is provided in the separator 13. One end of the separator screw 130 is connected to a drive motor 131, which is provided on a corresponding end of the upper surface of the separator 13.

The impellers 14 are installed on the upper surface of the shot room 10 and are coupled to the separator 13. The impellers 14 discharge shot balls, which are supplied from the separator 13, into the shot room 10.

The conveyor lifting units 15 are respectively provided on the first and second ends of the upper surface of the base 22. In detail, as shown in FIG. 1, each conveyor lifting unit 15 includes a drive motor 150, which is provided on the upper surface of the base 22, a vertical moving screw 151, which is coupled at a lower end thereof to the drive motor 150 and is rotated by the operation of the drive motor 150, and a vertical moving block 152, which is threaded over the vertical moving screw 151 and is fastened to the central portion of the spring input conveyor 16*a* or the spring output conveyor 16*b*.

The spring input conveyor 16*a* is supported by the vertical moving block 152 of the conveyor lifting unit 15, which is provided on the first end of the upper surface of the base 22. The height of the spring input conveyor 16*a* is adjusted by the corresponding conveyor lifting unit 15.

The spring output conveyor 16*b* is supported by the vertical moving block 152 of the conveyor lifting unit 15, which is provided on the second end of the upper surface of the base 22. The height of the spring output conveyor 16*b* is adjusted by the corresponding conveyor lifting unit 15.

Furthermore, spring moving buckets 160*a* and 160*b* are respectively provided in the spring input conveyor 16*a* and the spring output conveyor 16*b* at positions spaced apart from each other at the same intervals as that between spring clamping units 20, which are provided on the clamping unit revolving chain 18 which will be explained later.

The width adjustment units 17 are respectively provided on the medial portions of the front and rear ends of the upper surface of the base 22 such that inner ends of the upper portions of the width adjustment units 17 are inserted into the shot room 10.

As shown in FIG. 3, each width adjustment unit 17 includes a drive motor 170, which is provided on each of the medial portions of the front and rear ends of the upper surface of the base 22, and a width adjustment screw 172, which is rotatably supported at the opposite ends thereof by support brackets 171 provided on the upper surface of the base 22. One end of the width adjustment screw 172 is coupled to the drive motor 170. The width adjustment unit 17 further includes a width adjustment block 173, which is threaded over the width adjustment screw 172, and a width adjustment support 174, which is provided on the upper surface of the width adjustment block 173 such that the inner end thereof is inserted into the shot room 10. A plurality of drive sprockets (not shown), which rotate the clamping unit revolving chain 18, is provided on the upper surface of the width adjustment support 174.

Each clamping unit revolving chain 18 is wrapped at two positions around the drive sprockets 23 and 23*a*, which are rotatably provided on the respective opposite ends of the upper surface of the width adjustment support 174 of the corresponding width adjustment unit 17. The clamping unit revolving chain 18 is placed on the width adjustment support 174 of the width adjustment unit 17 such that a portion of the clamping unit revolving chain 18 is disposed in the shot room 10. The clamping unit revolving chain 18 is revolved around the drive sprockets by the rotation of the drive sprocket 23 that is coupled to the sprocket drive unit 19, which will be explained later.

The sprocket drive unit 19 is provided on the second end of the upper surface of the shot room 10 and is coupled to the drive sprockets 23, which are provided on the second ends of the upper surfaces of the respective width adjustment units 17.

In detail, as shown in FIGS. 4*a* and 4*b*, the sprocket drive unit 19 includes a pair of rotating force transmitting shafts 190, which are coupled at lower ends thereof to the drive sprockets 23 that are provided on the ends of the upper surfaces of the respective width adjustment units (not shown) and are connected to the respective clamping unit revolving chains 18. The sprocket drive unit 19 further includes a gear box 191, which is provided on the second end of the upper surface of the shot room 120 and is coupled to the upper ends of the rotating force transmitting shafts 190, and a drive motor 192, which is coupled to the gear box 191.

Here, as shown in FIGS. 4*a* and 4*b*, the gear box 191 includes a drive gear 191*a*, which is connected to the drive motor 192 and is rotated by the operation of the drive motor 192, and a first driven gear 191*b*, which engages with the drive gear 191*a* at a first position and is connected to the upper end of one of the rotating force transmitting shafts 190 to rotate the corresponding rotating force transmitting shaft 190 in the direction opposite the direction, in which the drive gear 191*a* rotates. The gear box 191 further includes a second driven gear 191*c*, which engages with the drive gear 191*a* at a second position and rotates in the direction opposite the direction, in which the drive gear 191*a* rotates, and a third driven gear 191*d*, which engages with the second driven gear 191*c* and is connected to the upper end of a remaining one of the rotating force transmitting shafts 190, thus rotating the corresponding rotating force transmitting shaft 190 in the direction, in which the drive gear 191*a* rotates.

Meanwhile, as shown in FIGS. 4*a* through 6, the spring clamping units 20 are mounted to each clamping unit revolving chain 18 at position spaced apart from each other at regular intervals such that the spring clamping units 20 are oriented outwards with respect to the clamping unit revolving chain 18.

Each spring clamping unit 20 includes a coupling member 200, which is coupled at a first end thereof to the clamping unit revolving chain 18 such that it is oriented outwards with respect to the clamping unit revolving chain 18, and a rotation member 202, which is rotatably fitted at a first end thereof over a circumferential outer surface of a second end of the coupling member 200. Here, the first end of the rotation member 202 is supported on the second end of the coupling member 200 so as to be rotatable around the coupling member 200 using a plurality of bearings 201 provided therebetween. The spring clamping unit 20 further includes a sprocket 203, which is provided on the central portion of the circumferential outer surface of the rotation member 202 and engages with the corresponding clamping unit rotating chain 21, so that the sprocket 203 is rotated by the clamping unit rotating chain 21 when the coupling member 200 is moved by the clamping unit revolving chain 18, thus rotating the rotation member 202. The spring clamping unit 20 further includes a support member 205, which is coupled at a first end thereof to a second end of the rotation member 202 using a plurality of locking members 204 such that it is rotated by the rotation of the rotation member 202, and holding members 206, which are mounted at first ends thereof to a second end of the support member 205 and are disposed into a circular arrangement. Second ends of the holding members 206 are inserted into one end of a coil spring 24 to hold the coil spring 24.

To easily align the center of the holding members 206 with the center of the coil spring 24, which is fitted over the second ends of the holding members 206, it is preferable that each holding member 206 have a right-angled triangular shape in which the width of the holding member 206 is increased from its second end, which is inserted into the end of the coil spring 24, to the first end thereof.

The clamping unit rotating chain 21 is provided on the width adjustment unit 17 such that it is disposed outside the corresponding clamping unit revolving chain 18. Furthermore, the clamping unit rotating chain 21 engages with the medial portions of the spring clamping unit 20, that is, it engages with the sprockets 203 provided on the respective rotation members 202, thus rotating the spring clamping units 20 on their own axes, the spring clamping units 20 being revolved around the corresponding sprockets 23 and 23*c* by the corresponding clamping unit revolving chain 18.

The operation of the stress shot peening apparatus according to the embodiment of the present invention will be explained below with reference to FIGS. 1 through 7.

First, the drive motors 150 of the conveyor lifting units 15 are operated. Then, the vertical moving screws 151, which are coupled to the respective drive motors 150, are rotated, so that the vertical moving blocks 152, which are threaded over the respective vertical moving screws 151, are moved upwards or downwards, thus adjusting the heights of the spring input conveyor 16*a* and the spring output conveyor 16*b* such that the spring clamping units 20 are aligned with the coil springs 24, which are moved by the spring moving buckets 160*a* that are installed on the spring input conveyor 16*a* and the spring output conveyor 16*b*.

As such, after the heights of the spring input conveyor 16*a* and the spring output conveyor 16*b* are adjusted, the width adjustment units 17 are operated to adjust the distance between the two clamping unit revolving chains 18, which are provided on the respective width adjustment units 17, the distance between the two clamping unit rotating chains 21 and the distance between the spring clamping units 20 which face each other and are mounted at the first ends thereof to the two corresponding clamping unit revolving chains 18.

In detail, as shown in FIG. 3, when each width adjustment screw 172 is rotated by the operation of the drive motor 170 of the corresponding width adjustment unit 17, the corresponding width adjustment block 173 is moved towards the front or rear end of the base 22 along the corresponding width adjustment screw 172. At this time, each width adjustment support 174, along with the corresponding width adjustment block 173, is moved towards the front or rear end of the base 22. By the forward or backward movement of the width adjustment support 174 of each width adjustment unit 17 with respect to the base 22, the clamping unit revolving chain 18 and the clamping unit rotating chain 21, which are provided on the corresponding width adjustment support 174, and the spring clamping units 20, which are coupled at the first ends thereof to the clamping unit revolving chain 18, are moved towards the front or rear end of the base 22 in conjunction with the width adjustment support 174. As a result, the distances between the spring clamping units 20, which face each other and are mounted to the two clamping unit revolving chains 18, are adjusted.

At this time, the distances between the spring clamping units 20 which face each other must be maintained such that they are shorter than lengths L of the corresponding coil springs 24 to be treated by shot peening. The reason for this is that each coil spring 24 is held between the corresponding spring clamping units 20 in a state of being compressed.

As such, after adjusting the distances between the spring clamping units 20 which face each other, the spring input conveyor 16*a* and the spring output conveyor 16*b* are operated and, simultaneously, the sprocket drive unit 19 is operated to actuate the clamping unit revolving chains 18.

In other words, when the operation of the spring input conveyor 16*a* and the spring output conveyor 16*b* begin, the drive motor 192 of the sprocket drive unit 19, shown in FIGS. 4 and 5, is also operated. Thereby, the drive gear 191*a* of the gear box 191 is rotated in a first direction. When the drive gear 191*a* rotates in the first direction, the first driven gear 191*b* and the second driven gear 191*c* which engage with the drive gear 191*a* are rotated using the rotating force, transmitted from the drive gear 191*a*, in a second direction opposite the first direction. Then, the rotating force transmitting shaft 190, which is coupled to the first driven gear 191*b*, is also rotated in the second direction. Simultaneously, the third driven gear 191*d*, which engages with the second driven gear 191*c*, is rotated in the first direction using the rotating force transmitted from the second driven gear 191*c*. Thereby, the rotating force transmitting shaft 190, which is coupled to the third driven gear 191*d*, is also rotated in the first direction.

As such, when the two rotating force transmitting shafts 190, which are respectively coupled at the upper ends thereof to the first driven gear 191*b* and the third driven gear 191*d*, are rotated in the opposite directions, the drive sprocket 23, which is connected to the lower end of the rotating force transmitting shaft 190 coupled to the first driven gear 191*b*, is rotated in the second direction, and the drive sprocket 23, which is connected to the lower end of the rotating force transmitting shaft 190 coupled to the third driven gear 191*d*, is rotated in the first direction. Hence, the two clamping unit revolving chains 18 are revolved in the opposite directions. As a result, the spring clamping units 20, which face each other and are mounted to the clamping unit revolving chain 18, are moved from the spring input conveyor 16*a* to the spring output conveyor 16*b*.

In the above state, coil springs 24 to be treated by shot peening are consecutively placed onto the respective corresponding spring moving buckets 160*a*, which are provided on and moved by the spring input conveyor 16*a*.

The coil springs 24, which are consecutively placed onto the respective corresponding spring moving buckets 160*a*, are moved in a row by the spring input conveyor 16*a* towards the space between the two clamping unit revolving chains 18.

As such, while the coil springs 24 are consecutively moved towards the clamping unit revolving chains 18, opposite ends of each coil spring 24, which reach the end of the spring input conveyor 16*a* which is adjacent to the clamping unit revolving chains 18, are held by the holding members 207 of the corresponding two of the spring clamping units 20, which are consecutively moved towards the end of the spring input conveyor 24, so that the coil spring 24 is clamped between the holding members 206 of the two spring clamping units 20 which face each other. The coil springs 24, which are clamped between the corresponding holding members 206, are continuously moved, along with the spring clamping units 20, by the clamping unit revolving chains 18 from the spring input conveyor 16*a* towards the spring output conveyor 16*b*.

Here, because the distances between the holding members 206 of the spring clamping units 20 which face each other are shorter than the lengths of the coil springs 24, when the coil springs 24 are clamped between the holding members 206 of the corresponding spring clamping units 20 which face each other, the coil springs 24 are compressed by the holding members 206 of the spring clamping units 20.

Furthermore, because the sprockets 203 of the spring clamping units 20, which are moved by the clamping unit revolving chains 18, engage with the corresponding clamping unit rotating chains 21, when the spring clamping units 20 are moved by the clamping unit revolving chains 18, the sprockets 203 of the spring clamping units 20 are rotated on their own axes by the corresponding clamping unit rotating chains 21. Thus, the rotation members 202, the support members 205 and the holding members 206, along with the sprockets 203, are also rotated on their own axes. As a result, the coil springs 24, the opposite ends of which are held by the corresponding holding members 206, are also rotated along with the holding members 206.

In other words, as shown in FIG. 7, each clamping unit rotating chain 21 is stationary. The sprockets 203, which engage with the clamping unit rotating chain 21, are provided on the circumferential outer surface of the rotation member 202, which is rotatably coupled to the coupling member 200. Therefore, when the spring clamping units 20 are moved by the corresponding clamping unit revolving chains 18, the sprockets 203 are rotated by the corresponding clamping unit rotating chains 21. The rotating force of each sprocket 203 is transmitted to the rotation member 202, the support member 205 and the holding members 206, consecutively. As a result, the coil springs 24, which are clamped by the corresponding holding members 206, are rotated.

As such, the coil springs 24 are moved towards the spring output conveyor 16*b* in a row in the state of being compressed and rotated by the corresponding spring clamping units 20 which face each other. The coil springs 24 enter the shot room 10 before reaching the spring output conveyor 16*b*. In the shot room 10, the surfaces of the coil springs 24 are consecutively treated by shot peening by shot balls discharged from the impellers 14.

At this time, because the coil springs 24, which are clamped by the spring clamping units 20 facing each other, are rotated, shot balls discharged from the impellers 14 can evenly strike the surfaces of the coil springs 24. Therefore, as well as a typical cylindrical coil spring, a side load coil spring, which is increased in diameter from the opposite ends thereof to the medial portion thereof, can be evenly treated throughout the entire surface thereof by shot peening. Furthermore, because the coil springs 24 are clamped by the corresponding spring clamping units 20 facing each other in the state of being compressed by the corresponding spring clamping units 20 and are rotated while passing through the shot room 10 for shot peening, the internal stress of the coil springs can be markedly increased, compared to that of coil springs treated by the conventional shot peening apparatus.

In addition, shot balls, which have been discharged by the impellers 14, are collected to the central portion of the bottom of the shot room 10 by the screws 101, which are rotated by the drive motor 102. Thereafter, the shot balls are discharged to the bucket conveyors 11 and are moved to the separator 13 by the bucket conveyors 11. Subsequently, the shot balls are supplied to the impellers 14 by the separator screw 130 that is rotated by the operation of the drive motor 131, after impurities are removed from the shot balls. Due to such shot ball supply process, the shot balls are repeatedly discharged into the shot room 10 by the impeller 14.

The coil springs 24, which have been consecutively treated by shot peening in the shot room 10, are moved to the outside of the shot room 10 towards the spring output conveyor 16*b* by the spring clamping units 20 that are moved along with the clamping unit revolving chains 18.

With respect to the spring clamping units 20 which face each other and are moved by the two corresponding clamping unit revolving chains 18, because the two clamping unit revolving chains 108 engage with the corresponding drive sprockets 23 and are revolved around the drive sprockets 23, the distances between the spring clamping units 20 facing each other are increased from the end of the spring output conveyor 16*b*, which is adjacent to the clamping unit revolving chains 18, to the drive sprockets 23. Therefore, when the spring clamping units 20, which are moved by the corresponding clamping unit revolving chains 18, consecutively reach the end of the spring output conveyor 16*b* which is adjacent to the clamping unit revolving chains 18, the coil springs 24, clamped by the spring clamping units 20 facing each other, are removed from the corresponding spring clamping units 20 and then consecutively placed onto the corresponding spring moving buckets 160*b*, which are provided on and moved by the spring output conveyor 16*b*. Thereafter, the coil springs 24 are discharged to the outside of the apparatus by the spring output conveyor 16*b*.

As described above, the stress shot peening apparatus 1 according to the embodiment of the present invention is constructed such that coil springs 24 to be treated by shot peening are clamped by the corresponding spring clamping units 20 facing each other and are rotated and simultaneously moved into the shot room 10 for shot peening. Therefore, as well as a typical cylindrical coil spring, various kinds of side load coil springs, for example, a side load coil spring, which is increased in diameter from the opposite ends thereof to the medial portion thereof, a pigtail type side load coil spring which is reduced in diameter to the opposite ends thereof, or a side load coil spring, the center axis of which is bent like a bow, can be evenly treated throughout the entire surface thereof by shot peening.

Furthermore, because the coil springs 24, which are compressed and clamped by the corresponding spring clamping units 20 facing each other, are rotated on their own axes and are simultaneously supplied into the shot room 10 for shot peening, the internal stress of the coil springs can be markedly increased, compared to that of coil springs treated by the conventional shot peening apparatus.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. An apparatus for stress shot peening of a coil spring, comprising:

a pair of bucket conveyors provided on a rear portion of a base, the bucket conveyors being mounted at lower ends thereof to an upper surface of the base;

a shot room coupled at a lower end thereof to the lower ends of the bucket conveyors, with a pair of screws provided in a central portion of a lower end of the shot room, the screws being coupled to each other by a connection member, wherein one selected from between the screws is coupled to a first drive motor provided on the upper surface of the base;

a separator coupled at opposite ends thereof to the respective bucket conveyors, with a separator screw provided in the separator, the separator screw being connected at one end thereof to a second drive motor;

a plurality of impellers provided on an upper surface of the shot room and coupled to the separator to discharge shot balls into the shot room;

conveyor lifting units respectively provided on first and second ends of the upper surface of the base;

a spring input conveyor coupled to the conveyor lifting unit provided on the first end of the upper surface of the base, the spring input conveyor being adjusted in height by the corresponding conveyor lifting unit;

a spring output conveyor coupled to the conveyor lifting unit provided on the second end of the upper surface of the base, the spring output conveyor being adjusted in height by the corresponding conveyor lifting unit;

width adjustment units respectively provided on medial portions of front and rear ends of the upper surface of the base such that inner ends of upper portions of the width adjustment units are disposed in the shot room;

a clamping unit revolving chain provided on each of the width adjustment units such that a portion of the clamping unit revolving chain is disposed in the shot room, the clamping unit revolving chain being wrapped at two positions around drive sprockets, which are rotatably provided on respective opposite ends of an upper surface of the corresponding width adjustment unit, so that the clamping unit revolving chain is revolved around the drive sprockets by the drive sprockets;

a sprocket drive unit provided on a second end of the upper surface of the shot room, the sprocket drive unit being coupled to the drive sprockets provided on the corresponding ends of the upper surfaces of the respective width adjustment units;

a plurality of spring clamping units mounted to each clamping unit revolving chain at position spaced apart from each other at regular intervals, the spring clamping units being oriented outwards with respect to the clamping unit revolving chain; and a clamping unit rotating chain provided on each of the width adjustment units, the clamping unit rotating chain being disposed outside the corresponding clamping unit revolving chain, the clamping unit rotating chain engaging with medial portions of the corresponding spring clamping units, thus rotating the spring clamping units on axes thereof, the spring clamping units being revolved around the corresponding sprockets by the corresponding clamping unit revolving chain.

2. The apparatus according to claim 1, wherein each of the conveyor lifting units comprises:

a third drive motor provided on the upper surface of the base;

a vertical moving screw coupled at a lower end thereof to the third drive motor, the vertical moving screw being rotated by operation of the third drive motor; and a vertical moving block threaded over the vertical moving screw, the vertical moving block being fastened to a central portion of the spring input conveyor or the spring output conveyor.

3. The apparatus according to claim 1, wherein each of the width adjustment units comprises:

a fourth drive motor provided on a medial portion of the front or rear end of the upper surface of the base;

a width adjustment screw rotatably supported at opposite ends thereof by support brackets provided on the upper surface of the base, the width adjustment screw being coupled at one end thereof to the fourth drive motor;

a width adjustment block threaded over the width adjustment screw; and a width adjustment support provided on an upper surface of the width adjustment block such that the inner end thereof is disposed in the shot room, the width adjustment support supporting thereon the corresponding drive sprockets, which revolve the corresponding clamping unit revolving chain.

4. The apparatus according to claim 1, wherein the sprocket drive unit comprises:

a pair of rotating force transmitting shafts coupled at lower ends thereof to the drive sprockets that are provided on second ends of upper surfaces of the respective width adjustment units and are connected to the respective clamping unit revolving chains;

a gear box provided on a second end of an upper surface of the shot room, the gear box being coupled to upper ends of the rotating force transmitting shafts; and a fifth drive motor coupled to the gear box.

5. The apparatus according to claim 4, wherein the gear box comprises:

a drive gear connected to the fifth drive motor, the drive gear being rotated by operation of the drive motor;

a first driven gear engaging with the drive gear at a first position, the first driven gear being connected to an upper end of one of the rotating force transmitting shafts to rotate the corresponding rotating force transmitting shaft in a direction opposite a direction, in which the drive gear rotates;

a second driven gear engaging with the drive gear at a second position to rotate in a direction opposite the direction, in which the drive gear rotates; and a third driven gear engaging with the second driven gear, the third driven gear being connected to an upper end of a remaining one of the rotating force transmitting shafts to rotate the corresponding rotating force transmitting shaft in the direction, in which the drive gear rotates.

6. The apparatus according to claim 1, wherein each of the spring clamping units comprises:

a coupling member coupled at a first end thereof to the corresponding clamping unit revolving chain such that the coupling member is oriented outwards with respect to the clamping unit revolving chain;

a rotation member rotatably coupled at a first end thereof to a circumferential outer surface of a second end of the coupling member;

a sprocket provided on a central portion of a circumferential outer surface of the rotation member, the sprocket engaging with the corresponding clamping unit rotating chain, so that the sprocket is rotated by the clamping unit rotating chain when the coupling member is moved by the clamping unit revolving chain, thus rotating the rotation member;

a support member coupled at a first end thereof to a second end of the rotation member using a plurality of locking members such that the support member is rotated in conjunction with the rotation member; and holding members mounted at first ends thereof to a second end of the support member, the holding members being disposed into a circular arrangement, so that second ends of the holding members are inserted into one end of a coil spring to hold the coil spring.

7. The apparatus according to claim 6, wherein each of the holding members has a right-angled triangular shape, a width of which is increased from a second end thereof, which is inserted into the end of the coil spring, to the first end thereof.

* * * * *